US008186277B1

(12) United States Patent
King

(10) Patent No.: US 8,186,277 B1
(45) Date of Patent: May 29, 2012

(54) LEAD-FREE BULLET FOR USE IN A WIDE RANGE OF IMPACT VELOCITIES

(75) Inventor: Gary D. King, Madras, OR (US)

(73) Assignee: Nosler, Inc., Bend, OR (US)

( * ) Notice: Subject to any disclaimer, the term of this patent is extended or adjusted under 35 U.S.C. 154(b) by 492 days.

(21) Appl. No.: 12/100,495

(22) Filed: Apr. 10, 2008

Related U.S. Application Data

(60) Provisional application No. 60/923,078, filed on Apr. 11, 2007.

(51) Int. Cl.
*F42B 12/34* (2006.01)

(52) U.S. Cl. ..... 102/507; 102/509

(58) Field of Classification Search ..... 102/501, 102/503, 507, 508, 509; D22/116
See application file for complete search history.

(56) References Cited

U.S. PATENT DOCUMENTS 1,493,614 A * 5/1924 Dickerman ..... 102/510
3,972,286 A 8/1976 Canon
4,044,685 A 8/1977 Avcin et al.
4,385,545 A 5/1983 Duer
4,385,546 A 5/1983 Lee
4,619,203 A 10/1986 Habbe
4,644,866 A 2/1987 Sullivan
4,655,140 A * 4/1987 Schirneker ..... 102/508
4,685,397 A 8/1987 Schirneker et al.
4,700,630 A 10/1987 Sullivan
4,777,883 A 10/1988 Chevich
4,811,666 A 3/1989 Lutfy
4,829,904 A 5/1989 Sullivan
4,856,160 A 8/1989 Habbe et al.
5,012,743 A 5/1991 Denis et al.
5,097,767 A 3/1992 Cirillo
5,127,332 A 7/1992 Corzine et al.
5,131,123 A 7/1992 Brooks
5,187,325 A 2/1993 Garvison
5,214,238 A 5/1993 Young
5,259,320 A 11/1993 Brooks
5,275,108 A 1/1994 Chernicky et al.
5,317,109 A 5/1994 Aldissi
5,399,187 A 3/1995 Mravic et al.
5,535,678 A 7/1996 Brown et al.
5,616,642 A 4/1997 West et al.
5,686,693 A 11/1997 Jakobsson et al.
5,811,723 A 9/1998 Stone
5,814,759 A 9/1998 Mravic et al.
5,877,437 A 3/1999 Oltrogge (Continued)

OTHER PUBLICATIONS

"Products You Can Count On—Every Time," Barnes Unleaded, Unfailing, Unbeatable, http://www.barnesbullets.com/about-us/history/, accessed Apr. 29, 2010, 6 pages.

(Continued)

*Primary Examiner* — Benjamin P Lee
(74) *Attorney, Agent, or Firm* — Perkins Coie LLP

(57) ABSTRACT

A bullet comprising a lead-free body having a tail section and a nose section. The nose section has an ogived outer surface and a forward terminus. The body further has an opening at the terminus, and a cavity in the nose section. The cavity extends rearward from the opening to an intermediate section of the body. The cavity includes a forward sidewall having at least a generally frusto-conical shape that converges rearward from the opening to a transition area. The cavity further includes a rear sidewall extending rearward from the transition area at a different angle than the forward sidewall.

25 Claims, 9 Drawing Sheets

U.S. PATENT DOCUMENTS

| | | | | |
|---|---|---|---|---|
| 5,894,644 | A | 4/1999 | Mravic | |
| 5,950,064 | A | 9/1999 | Robinson et al. | |
| 6,016,754 | A | 1/2000 | Enlow et al. | |
| 6,070,532 | A | 6/2000 | Halverson | |
| 6,074,454 | A | 6/2000 | Abrams et al. | |
| 6,085,661 | A | 7/2000 | Halverson et al. | |
| 6,105,506 | A | 8/2000 | Gangale | |
| 6,112,669 | A | 9/2000 | Mravic et al. | |
| 6,240,849 | B1 | 6/2001 | Holler | |
| 6,240,850 | B1 | 6/2001 | Holler | |
| 6,244,187 | B1 * | 6/2001 | Head | 102/516 |
| 6,257,149 | B1 | 7/2001 | Cesaroni et al. | |
| 6,311,623 | B1 | 11/2001 | Zaruba | |
| 6,439,124 | B1 | 8/2002 | Enlow et al. | |
| 6,439,125 | B1 | 8/2002 | Carter | |
| 6,530,328 | B2 | 3/2003 | Burczynski et al. | |
| 6,536,352 | B1 | 3/2003 | Nadkarni et al. | |
| 6,600,126 | B2 | 7/2003 | Steinhoff et al. | |
| 6,769,364 | B2 | 8/2004 | Kolodzey et al. | |
| 6,827,020 | B2 | 12/2004 | Fischer et al. | |
| 6,837,165 | B2 | 1/2005 | Eberhart et al. | |
| 6,964,232 | B2 | 11/2005 | Eberhart et al. | |
| 6,971,315 | B2 * | 12/2005 | Knappworst et al. | 102/510 |
| 6,973,879 | B1 | 12/2005 | McElroy et al. | |
| 7,000,547 | B2 | 2/2006 | Amick | |
| 7,036,433 | B2 | 5/2006 | Beal | |
| 7,059,233 | B2 | 6/2006 | Amick | |
| 7,150,233 | B1 | 12/2006 | Eberhart | |
| 7,299,733 | B2 | 11/2007 | Eberhart et al. | |
| 7,299,750 | B2 * | 11/2007 | Schikora et al. | 102/506 |
| 7,322,297 | B2 | 1/2008 | Yaich | |
| 7,487,727 | B2 | 2/2009 | Eberhart et al. | |
| 2002/0013099 | A1 | 1/2002 | Adkins et al. | |
| 2002/0157524 | A1 | 10/2002 | Tuftee | |
| 2003/0005846 | A1 | 1/2003 | Atwood | |
| 2005/0183616 | A1 | 8/2005 | Eberhart et al. | |
| 2005/0217529 | A1 | 10/2005 | O'Dwyer | |
| 2006/0124022 | A1 | 6/2006 | Eberhart et al. | |
| 2006/0278114 | A1 | 12/2006 | Millard | |
| 2007/0006770 | A1 | 1/2007 | Herrlinger | |
| 2007/0028793 | A1 * | 2/2007 | Sauvestre | 102/508 |
| 2007/0089628 | A1 | 4/2007 | Elder | |
| 2007/0144395 | A1 | 6/2007 | Yaich | |

OTHER PUBLICATIONS

"Winchester's New Supreme Elite™ XP3™ Bullet Incorporates Best Features of Modern Bullet Designs," Winchester Press Room http://web.archive.org/web/20051210195927/www.winchester.com/pressroom/news/pressreleases/releasedetail.aspx?storyid=149, Sep. 23, 2005, 1 page.

Barnes® Barnes MRX Bullet, 2009 catalog, p. 7 of the 2009 catalog, available at: http://www.barnesbullets.com/images/2009BarnesCatalog.web.pdf catalog, 1 page.

Extraordinary Bullets, "X-Bullet, Past and Present," http://www.shootingillustrated.com/Expert_Advice/Handloading/Extraordinary.html, 2010, 3 pages.

Lead Free Projectile, 2010 Winchester Ammunition, p. 13 of the 2010 catalog, available at: http://www.winchester.com/SiteCollectionDocuments/pdf/catalog/Winchester_Catalog_2010.pdf, 2010, 1 page.

* cited by examiner

LEAD-FREE BULLET FOR USE IN A WIDE RANGE OF IMPACT VELOCITIES

CROSS-REFERENCE TO RELATED APPLICATION(S)

This application claims the benefit of U.S. Provisional Patent Application No. 60/923,078 filed Apr. 11, 2007, entitled "LEAD-FREE BULLET FOR USE IN A WIDE RANGE OF IMPACT VELOCITIES," which is incorporated herein by reference in its entirety.

TECHNICAL FIELD

This invention relates to a lead-free bullet with a blind cavity that enables outward expansion of the bullet upon impact with a target over a wide range of impact velocities.

BACKGROUND

Lead has been used as a material in bullets for years, and many lead bullets have a nose portion with a hollow point or hollow cavity that enables the bullet to mushroom or petal upon impact with a target. Such mushrooming disperses most or all of the bullet's kinetic energy to the target. Lead has been widely used because it has a high density, good ductility, and low cost. However, there have been assertions that lead bullets present an issue of significant environmental contamination. There have also been claims that scavenger animals, such as the California condor, may have been subjected to lead poisoning from consuming animals shot with lead projectiles.

Bullet manufacturers have attempted to solve these purported problems in various ways. One such solution is to encase a lead core with a non-lead metal. For example, U.S. Pat. No. 5,127,332 discloses a hunting bullet with an encapsulated lead core that purports to minimize contamination of animal tissue. However, certain jurisdictions have entirely banned the use of bullets with any lead for hunting certain game.

Another solution is a completely lead-free bullet. U.S. Pat. No. 4,685,397, for example, discloses a completely lead-free bullet preferably made of tombac that has a cylindrical cavity in the nose and a cap. However, such lead-free bullets generally do not have consistent performance characteristics over a wide range of velocities and uses because the materials do not have the same properties as lead. More specifically, if the opening at the nose of the bullet is too large, or if the cylindrical cavity is too deep, then the bullet may mushroom to the extent that the petals fragment from the bullet upon impact. This can reduce the efficacy of the bullet. Conversely, if the opening at the nose of the bullet is too small, then the bullet may not petal adequately upon impacting a target at low velocity. This also reduces the efficacy of the bullet.

Accordingly, a lead-free bullet that has consistent performance characteristics over a wide range of velocities and uses would have significant utility.

DETAILED DESCRIPTION

A. Overview

Figure 1:
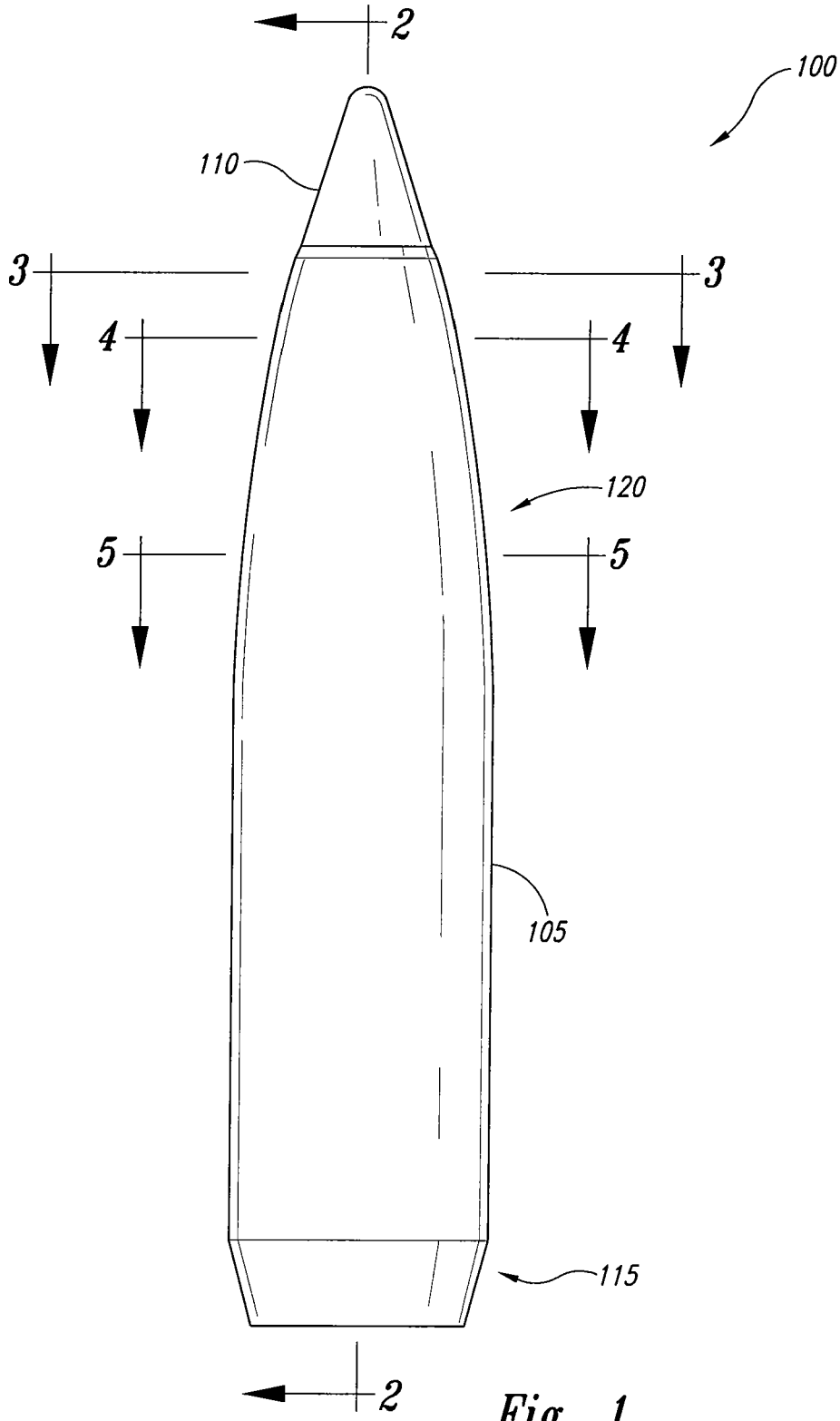
FIG. 1 is an enlarged side view of a bullet in accordance with an embodiment of the invention.

The present disclosure describes a lead-free bullet with an opening that can enable the bullet to be used over a wide range of velocities and applications. Several embodiments in accordance with the invention are set forth in FIGS. 1-12 and the following text to provide a thorough understanding of particular embodiments of the invention. Moreover, several other embodiments of the invention can have different configurations, components or procedures than those described in this section. A person skilled in the art will understand, therefore, that the invention may have additional embodiments, or that the invention may be practiced without several details of the embodiments shown in FIGS. 1-12.

In one embodiment, the bullet has a lead-free body that has a tail section and a nose section with an ogived outer surface and a forward terminus. The body also has an opening at the terminus and a cavity in the nose section. The cavity extends rearward from the opening to an intermediate section of the body. The cavity includes a forward sidewall having at least a generally frusto-conical shape that converges rearward from the opening to a transition area and a rear sidewall extending rearward from the transition area at a different angle than the forward sidewall.

In another embodiment, the bullet has a lead-free body that has a tail section, a nose section with an ogived outer surface and a forward terminus, an opening at the terminus, and a cavity in the nose section. The cavity includes a forward sidewall extending rearward from the opening, skives in the forward sidewall, and a rear sidewall extending rearward relative to the forward sidewall. Upon impact in animal tissue over a broad range of impact velocities, the forward sidewall and the rear sidewall are configured to form petals that remain with the body. For example, the forward sidewall and the rear sidewall of the body of a 30 caliber, 180 grain bullet are configured to form petals that remain with the body upon impact in animal tissue at impact velocities of approximately 1,800 feet per second to approximately 3,200 feet per second.

For other bullets with other calibers and/or other grain values, the range of impact velocities may be different.

In still another embodiment, the bullet has a lead-free body that has a tail section and a nose section with an ogived outer surface and a forward terminus. The body also has an opening at the forward terminus and a cavity in the nose section. The cavity extends rearward from the opening to an intermediate section of the body. The cavity includes a forward sidewall having at least a generally frusto-conical shape that converges rearward from the opening to a transition area, and a rear sidewall extending rearward from the transition area at a different angle than the forward sidewall. The body has a maximum cross-sectional dimension and the opening has a first cross-sectional dimension. The ratio of the first cross-sectional dimension to the maximum cross-sectional dimension is from approximately 0.30 to approximately 0.40. The body also has a length and the ratio of the transition area location rearward of the forward terminus to the body length is from approximately 0.20 to approximately 0.25. The cavity has a second cross-sectional dimension at the transition area and the ratio of the second cross-sectional dimension to the maximum cross-sectional dimension is from approximately 0.15 to approximately 0.25.

Methods of manufacturing a bullet in accordance with embodiments of the invention are also described. One embodiment of such a method, for example, comprises forming a cavity at a first end portion of a slug of lead-free material such that the cavity has an opening and a forward sidewall that has a surface converging rearward from the opening at a first angle. This embodiment of the method also includes forming a rear sidewall in the cavity that extends rearward at a second angle different than the first angle, and contouring a nose portion to have an ogived outer surface and a forward terminus. The cavity extends rearward from the opening to a generally hemispherical end, the forward sidewall of the cavity converges rearward from the opening to a transition area, and the rear sidewall extends rearward at a different angle than the forward sidewall from the transition area to the generally hemispherical end.

B. Embodiments of Bullets and Processes of Making Bullets

FIG. 1 is an enlarged side view of a bullet 100 in accordance with an embodiment of the invention. The bullet 100 includes a lead-free body 105 having a tail section 115 and a nose section 120, and the bullet 100 can further include a tip 110 at the nose section 120. The lead-free body 105 can be a continuous piece of material composed of unalloyed copper or a copper alloyed with another metal. A copper-zinc alloy, for example, may reduce depositions of copper on the interior surface of a gun barrel (i.e., "fouling") that could otherwise reduce the accuracy of the bullet. One suitable copper-zinc alloy that can be used for the lead-free body 105 is a copper 210 alloy. The lead-free body 105 can also be composed of other materials, such as tungsten. The tip 110 can be composed of a polymeric substance. In some embodiments, the tip 110 is colored differently according to the caliber of the bullet 100. For example, a 30-caliber bullet can have a tip with a green hue, and other calibers can have tips of different colors. A user can thus easily determine the caliber of a bullet by the color of the tip 110. The color of the tip 110, however, can be uniform across several calibers in other embodiments.

Figure 2A:
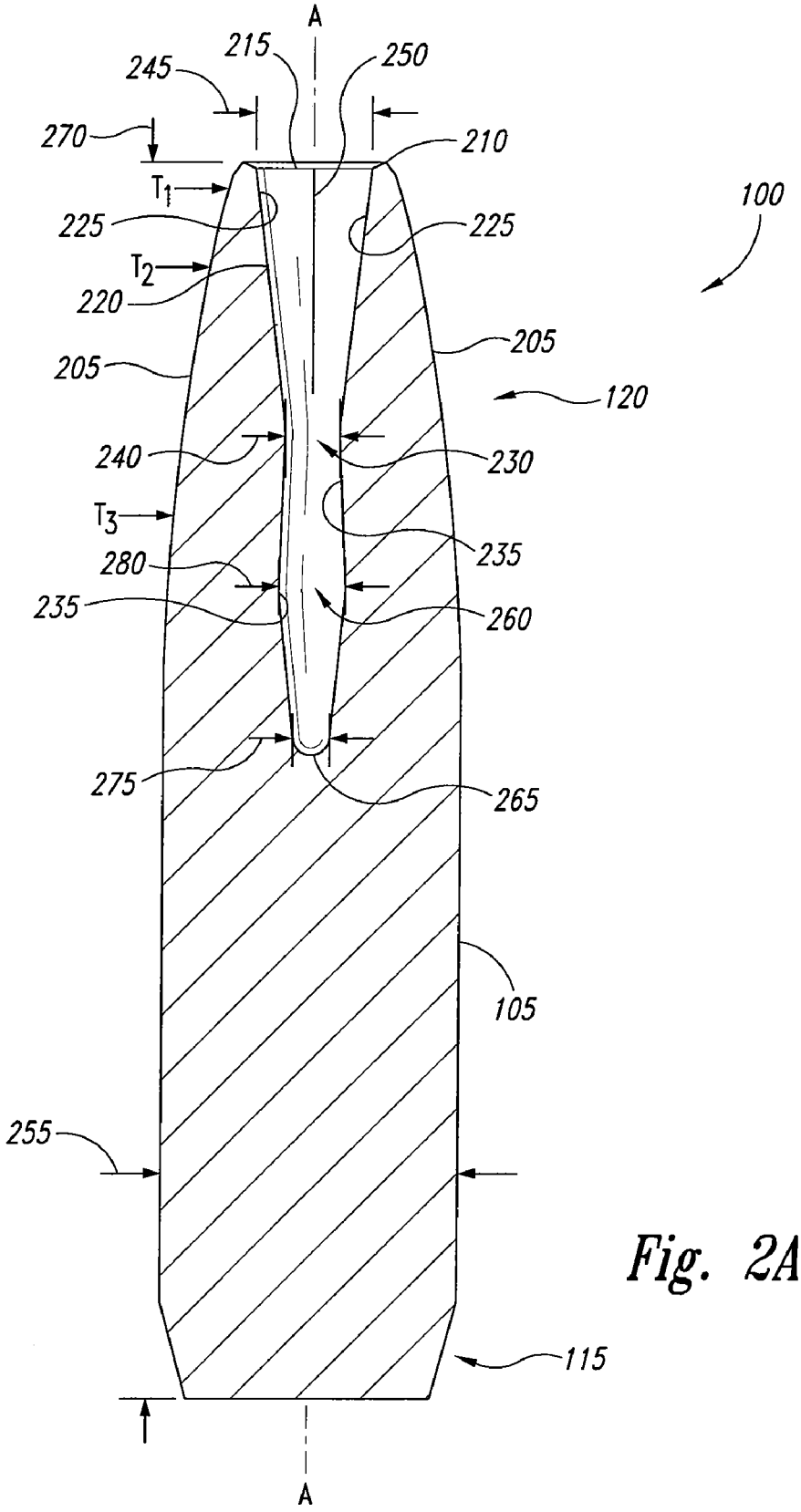
FIG. 2A is an enlarged cross-sectional side view of an embodiment of a body of a bullet taken along line 2-2 of FIG. 1.
Figure 2B:
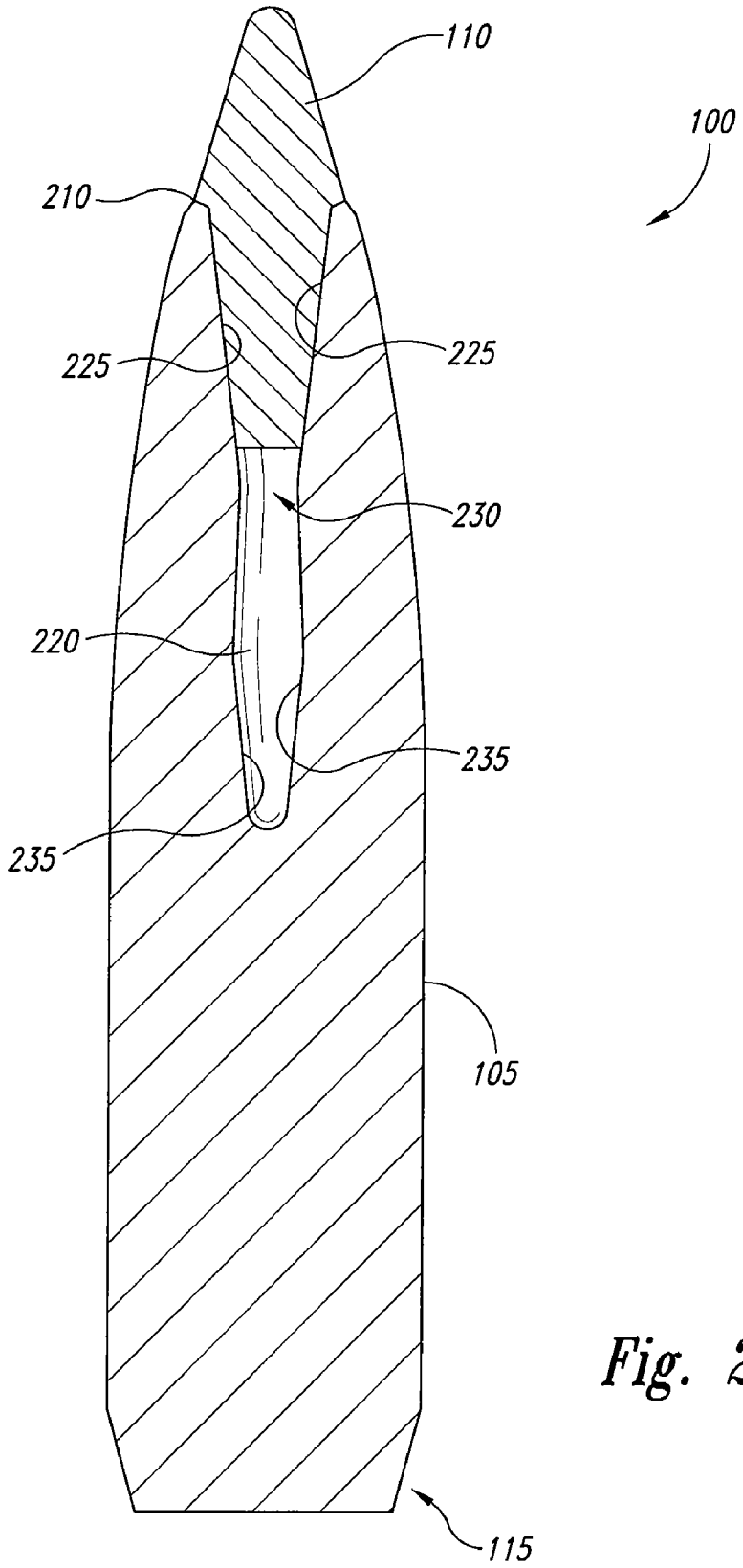
FIG. 2B is an enlarged cross-sectional side view taken along line 2-2 of FIG. 1 of a bullet in accordance with an embodiment of the invention.

FIGS. 2A-2B are enlarged cross-sectional side views taken along line 2-2 of FIG. 1 of a bullet in accordance with an embodiment of the invention. Like reference numbers refer to like components in FIGS. 1 and 2A-2B, and thus the description of such components will not be repeated with reference to the bullet 100 in FIGS. 2A-2B. Referring to FIG. 2A, the nose section 120 has an ogived outer surface 205 and a forward terminus 210. The body 105 has a maximum cross-sectional dimension 255 toward the tail section 115 and an opening 215 with a first cross-sectional dimension 245 at the forward terminus 210. The body 105 also has a cavity 220 in the nose section 120 that extends rearward from the opening 215 to an intermediate section of the body 105. The cavity 220 includes a forward sidewall 225 that converges rearward from the opening 215 to a first transition area 230 having a second cross-sectional dimension 240. The forward sidewall 225 in the embodiment shown in FIGS. 2A and 2B has at least a generally frusto-conical shape. For example, the embodiment of the forward sidewall 225 shown in FIGS. 2A and 2B has a slightly convex frusto-conical shape relative to the central longitudinal axis A-A of the body 105. In other embodiments, the forward sidewall 225 can have a straight frusto-conical shape or a concave frusto-conical shape relative to the central longitudinal A-A. The term "frusto-conical," accordingly, includes straight, convex and/or concave frusto-conical shapes. The cavity 220 can further include one or more skives 250 extending longitudinally along the forward sidewall 225. The skives 250, for example, can be longitudinal grooves at selected radial intervals around the inner circumference of the forward sidewall 225. The cavity 220 further includes a rear sidewall 235 that extends rearward from the first transition area 230 at a different angle relative to the forward sidewall 225. The rear sidewall 235, for example, can diverge rearwardly to a second transition area 260 having a third cross-sectional dimension 280 and then converge to form a generally hemispherical cavity end 265 having a fourth cross-sectional dimension 275. Several embodiments of the cavity 220 shown in FIGS. 2A and 2B have an hourglass-shape. In another embodiment, the rear sidewall 235 has a straight cylindrical surface from the first transition area 230 to near the cavity end 265 that is parallel to a central longitudinal axis of the body 105.

The shape and size of the combination of the cavity 220, opening 215 and outer surface 205 enable the bullet 100 to adequately expand upon impact without breaking apart over a much wider range of velocities and target types than previous lead-free bullets. This unique aspect of several embodiments of the bullet 100 can be described, at least in part, by ratios between various dimensions of the body 105 and cavity 220. In one embodiment, for example, the ratio of the first cross-sectional dimension 245 to the maximum cross-sectional dimension 255 is from approximately 0.30 to approximately 0.40. In another embodiment, the ratio of the second cross-sectional dimension 240 to the maximum cross-sectional dimension 255 is from approximately 0.15 to approximately 0.25. In yet another embodiment, the ratio of the third cross-sectional dimension 280 to the maximum cross-sectional dimension 255 is from approximately 0.20 to approximately 0.30. The ratio of the fourth cross-sectional dimension 275 to the maximum cross-sectional dimension 255 can be from approximately 0.10 to approximately 0.20. The foregoing ratios are merely several examples and are not limiting unless expressly listed.

The body 105 further has a length 270. In several embodiments, the first transition area 230 is located rearward of the forward terminus 210 by approximately 20-25% of the body length 270. Additionally, the ratio of the second transition area 260 location rearward of the forward terminus 210 to the body length 270 can be from approximately 0.30 to approximately 0.35, and the ratio of the generally hemispherical cavity end 265 location rearward of the forward terminus 210 to the body length 270 can range from approximately 0.45 to approximately 0.50. The ratios related to the length of the body are also merely examples and are not limiting unless expressly listed.

FIG. 2B illustrates the bullet 100 of FIGS. 1 and 2A including the tip 110. In this embodiment, a rear portion of the tip 110 is in the cavity 220 and a forward portion of the tip 110 projects forward from the forward terminus 210 of the body 105. The rear portion of the tip 110 accordingly abuts at least a portion of the forward sidewall 225 and extends rearward in the cavity 220.

Figure 3:
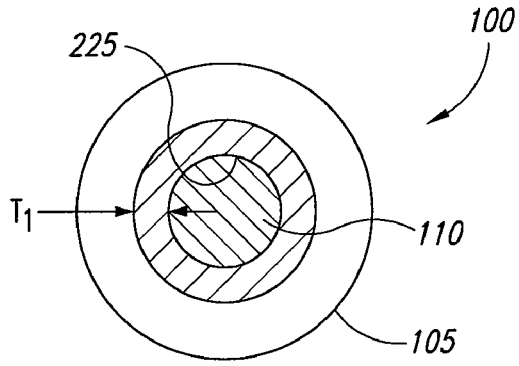
FIG. 3 is a cross-sectional top view taken along line 3-3 of FIG. 1 of a bullet in accordance with an embodiment of the invention.
Figure 4:
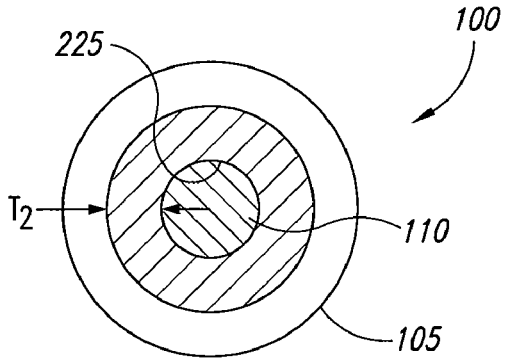
FIG. 4 is a cross-sectional top view taken along line 4-4 of FIG. 1 of a bullet in accordance with an embodiment of the invention.
Figure 5:
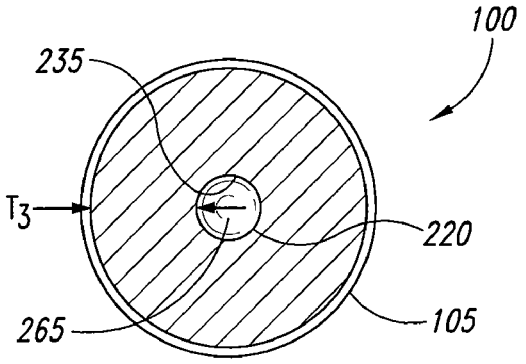
FIG. 5 is a cross-sectional top view taken along line 5-5 of FIG. 1 of a bullet in accordance with an embodiment of the invention.

FIGS. 3-5 are cross-sectional views of the bullet 100 taken along lines 3-3, 4-4 and 5-5 of FIG. 1, respectively, and like reference numbers refer to like components in FIGS. 1-5. The body 105 has a wall thickness $T_1$ at the line 3-3 shown in FIG. 1. The relatively large opening 215 (FIG. 2A) and the relatively thin wall thickness $T_1$ enable the bullet to initiate petaling along the skives 250 (FIG. 2A) at lower velocities and/or in softer targets than conventionally shaped lead-free bullets. The body 105 also has progressively larger wall thicknesses $T_2$ (FIG. 4) and $T_3$ (FIG. 5) toward the tail. The larger wall thickness at lines 4-4 and 5-5 prevent, or at least inhibit, the petals from separating from the body 105 at high velocity impacts. Additionally, it can be seen from contrasting FIGS. 3 and 4 that the forward sidewall 225 converges from the opening (not shown) to the first transition area (not shown) because the tip 110 in FIG. 4 has a smaller cross-section than the tip 110 in FIG. 3.

Several embodiments of the bullet provide adequate outward radial expansion at impact (i.e., petaling or mushrooming) without undue fragmentation (i.e., without completely separating the petals from the body). Referring again to FIGS. 2A and 2B, the opening 215 and forward sidewall 225 are configured to initiate petal formation when the bullet 100 impacts a target. More specifically, the large opening 215 and small wall thickness $T_1$ enable the body 105 to readily tear at the skives 250 and cause the petals to unfold. The tip 110 can further enable mushrooming because the impact force drives the tip 110 into the cavity 220. One advantage of several embodiments of the bullet 100 is that the configuration of the opening 215, the forward sidewall 225 of the cavity 220, and outer surface of the nose section 120 operate together with the type of material of the body such that the bullet 100 can petal at impact velocities of approximately 1,800 feet per second. Another advantage of several embodiments of the bullet 100 is that it can petal upon impact without undue fragmentation at much higher impact velocities. For example, the increasing thickness of the forward sidewall 225 toward the transition zone and the relatively larger thickness of the rear sidewall 235 increase the strength of the petals toward the tail such that the bullet can mushroom at high-velocity impacts of approximately 3,200 feet per second without fragmenting the petals. Such a configuration can also prevent the bullet 100 from mushrooming prematurely in flight before impacting the desired target.

Figure 6E:
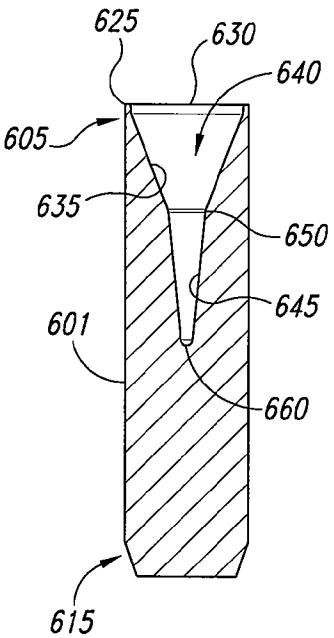
FIGS. 6A-6E are cross-sectional side views of various stages of a method for manufacturing a bullet in accordance with an embodiment of the invention.
Figure 6D:
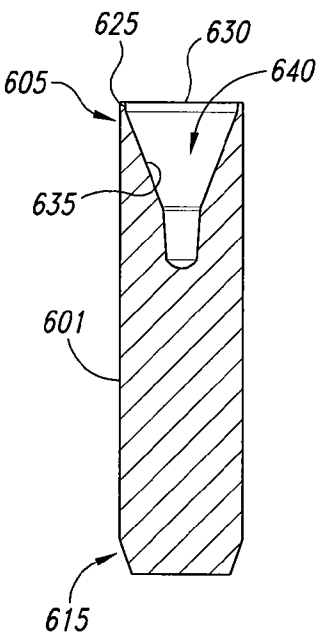
Figure 6C:
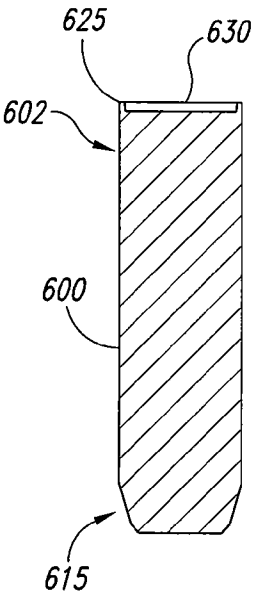
Figure 6B:
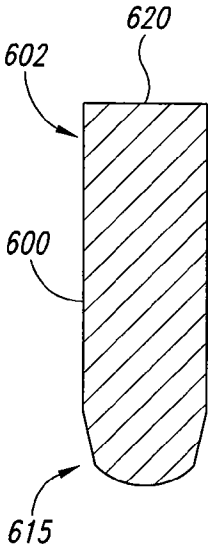
Figure 6A:
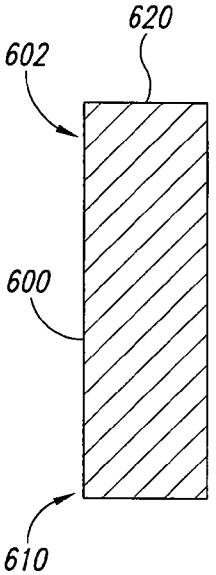

FIGS. 6A-6E are cross-sectional side views of stages of a method for manufacturing a bullet in accordance with an embodiment of the invention. In FIG. 6A, a slug of lead-free material is pressed into a die cavity (not shown) to form a generally cylindrical slug 600 having a first end portion 602 with a face 620 and a second end portion 610. FIG. 6B illustrates a stage at which an axial force (not shown) has been applied to the face 620 of the first end portion 602 to form the second end portion 610 into a tail portion 615. FIG. 6C illustrates a subsequent stage at which a punch (not shown) presses against the face 620 to further form the tail portion 615 and shape the slug 600 in another die cavity (not shown). In the embodiment shown in FIG. 6C, the punch forms a generally annular ring portion 625 and a recess 630 at the first end portion 602. In other embodiments, however, the punch of the stage shown in FIG. 6C may form a planar surface at the first end portion 602 without a ring portion or a recess. In FIG. 6D, the slug 600 has been formed into a body 601 having a first end portion 605 into which a first punch (not shown) has been driven to form a cavity 640 that includes a forward sidewall 635 extending rearward from the opening 630. As the first punch forms the cavity 640 in FIG. 6D, it finalizes the tail portion 615 in another die cavity (not shown). FIG. 6E illustrates the process after a second punch (not shown) has been applied to the first end portion 605 to further extend the cavity 640 to include a rear sidewall 645. The first and second punches can have conical shapes at different angles such that the forward sidewall 635 tapers at a first angle and the rear sidewall 645 tapers at a second angle different than the first angle. The cavity 640 can accordingly have a transition zone 650. The second punch can also have a spherical tip to form a semi-spherical end 660.

Figure 7:
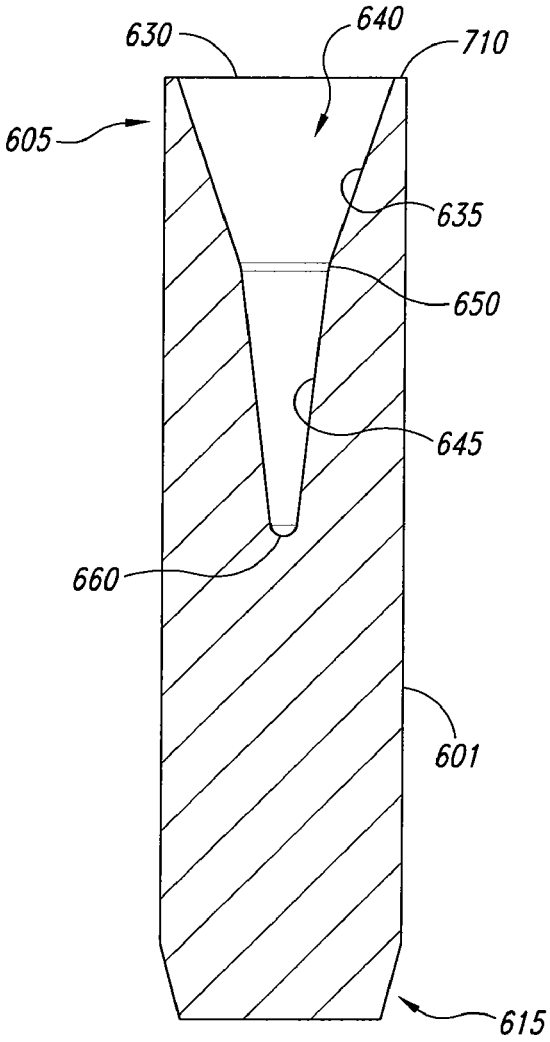
FIG. 7 is a cross-sectional side view of a bullet at a stage of a method for manufacturing a bullet in accordance with an embodiment of the invention.
Figure 8:
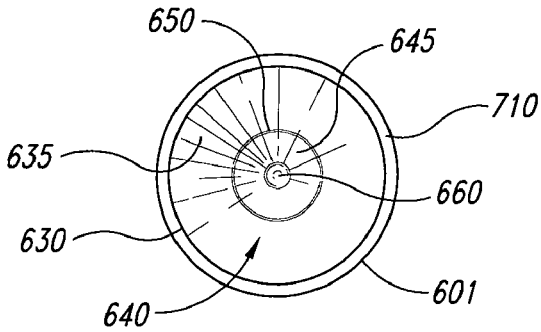
FIG. 8 is a top view of a bullet at the stage of a method for manufacturing a bullet illustrated in FIG. 7.

FIG. 7 is a side view and FIG. 8 is a top view of a bullet at a subsequent stage of an embodiment of a method. In FIG. 7, the ring portion 625 of FIG. 6E has been removed from the first end portion 605, but the nose section of the bullet has not yet been formed. The first end portion 605 has a portion 710 that will be formed into the nose section's forward terminus. FIGS. 7 and 8 together further illustrate the conical surfaces of the forward sidewall 635 and rear sidewall 645.

Figure 9:
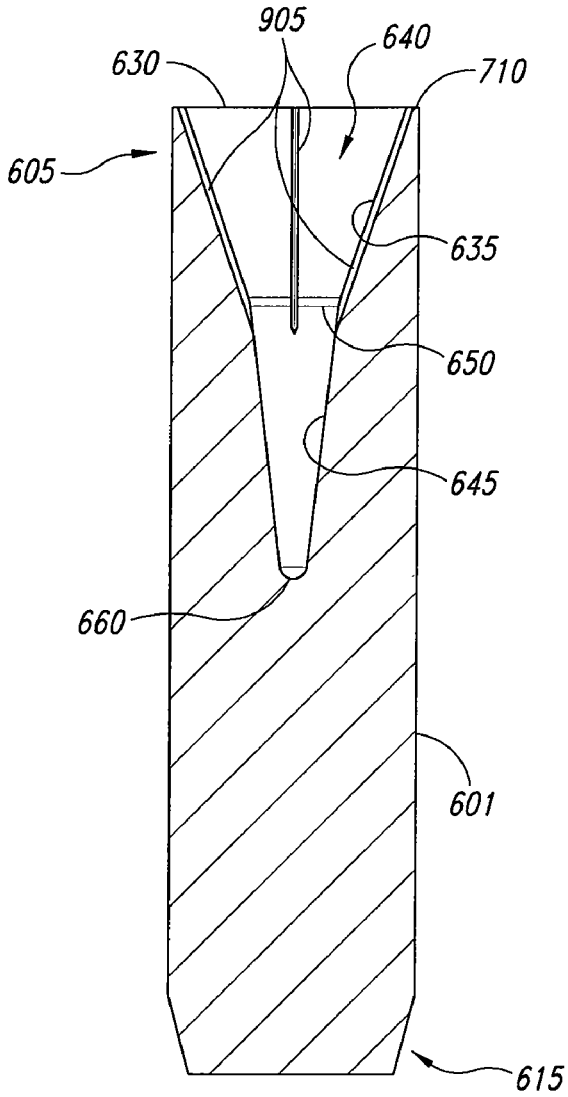
FIG. 9 is a cross-sectional side view of a bullet at a stage of a method for manufacturing a bullet in accordance with another embodiment of the invention.
Figure 10:
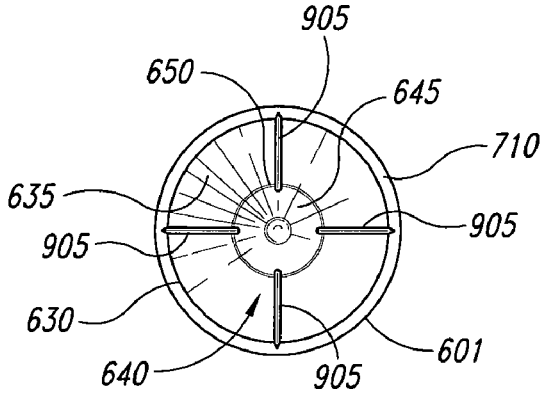
FIG. 10 is a top view of a bullet at the stage of a method for manufacturing a bullet illustrated in FIG. 9.

FIG. 9 is a side view and FIG. 10 is a top view of a bullet at a subsequent stage of an embodiment of the method for manufacturing a bullet. Like reference numbers refer to like components in FIGS. 7-10. In FIG. 9, a third punch (not shown) has been pressed into the cavity 640 to form longitudinal skives 905 in the forward sidewall 635 by driving the edges of a pyramidal punch (not shown) that has three or more triangular faces into the forward sidewall 635. The number of faces that a pyramidal punch has determines the number of skives. For example, a four-sided pyramidal punch has four edges that form four skives. In other embodiments, the skives 905 may be formed by engraving or etching the forward sidewall 635. The skives 905 reduce the structural integrity at specific sites around the body 601 to further enable the bullet to mushroom upon impacting a target. One advantage of forming the skives 905 with a pyramidal punch is that extensive working of the body 601 is not required, and thus the risk of any fragmentation of the bullet that may occur is lessened vis-à-vis other techniques.

Figure 11:
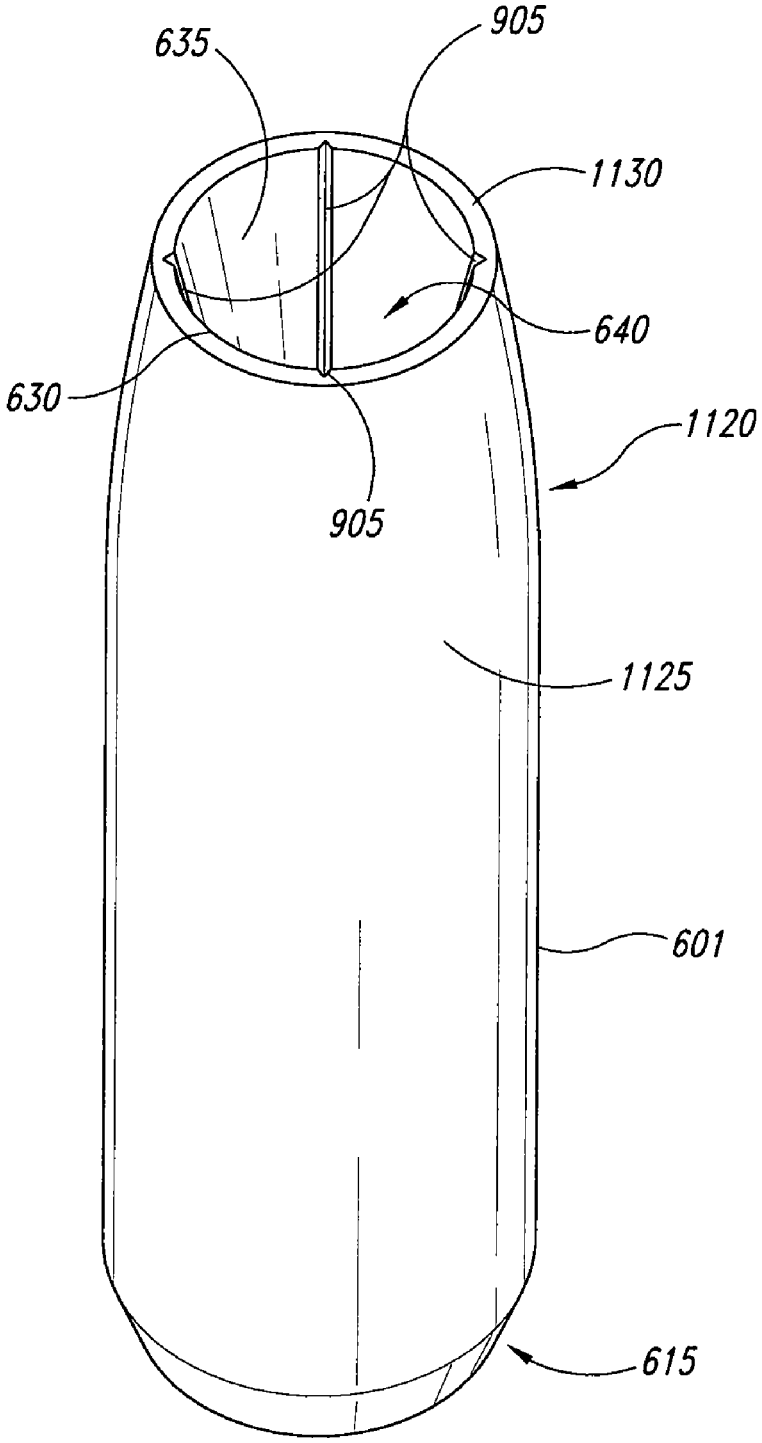
FIG. 11 is an enlarged isometric view of a bullet at a stage of a method for manufacturing a bullet in accordance with an embodiment of the invention.

FIG. 11 is an enlarged isometric view of a subsequent stage of a method for manufacturing a bullet in accordance with an embodiment of the invention. At this stage, the body 601 has been contoured to form a nose section 1120. The nose section 1120 can be formed by inserting the body 601 into an ogive die cavity (not shown) and applying an axial force (not shown) to the bottom face of the tail section 615. At the completion of this stage, the nose section 1120 has an ogived outer surface 1125, a forward terminus 1130, and an opening 630 at the terminus 1130. The cavity 640 includes the forward sidewall 635 that converges rearward from the opening 630 and the rear sidewall 645 extending toward the tail at a different angle than the forward sidewall 635.

Figure 12:
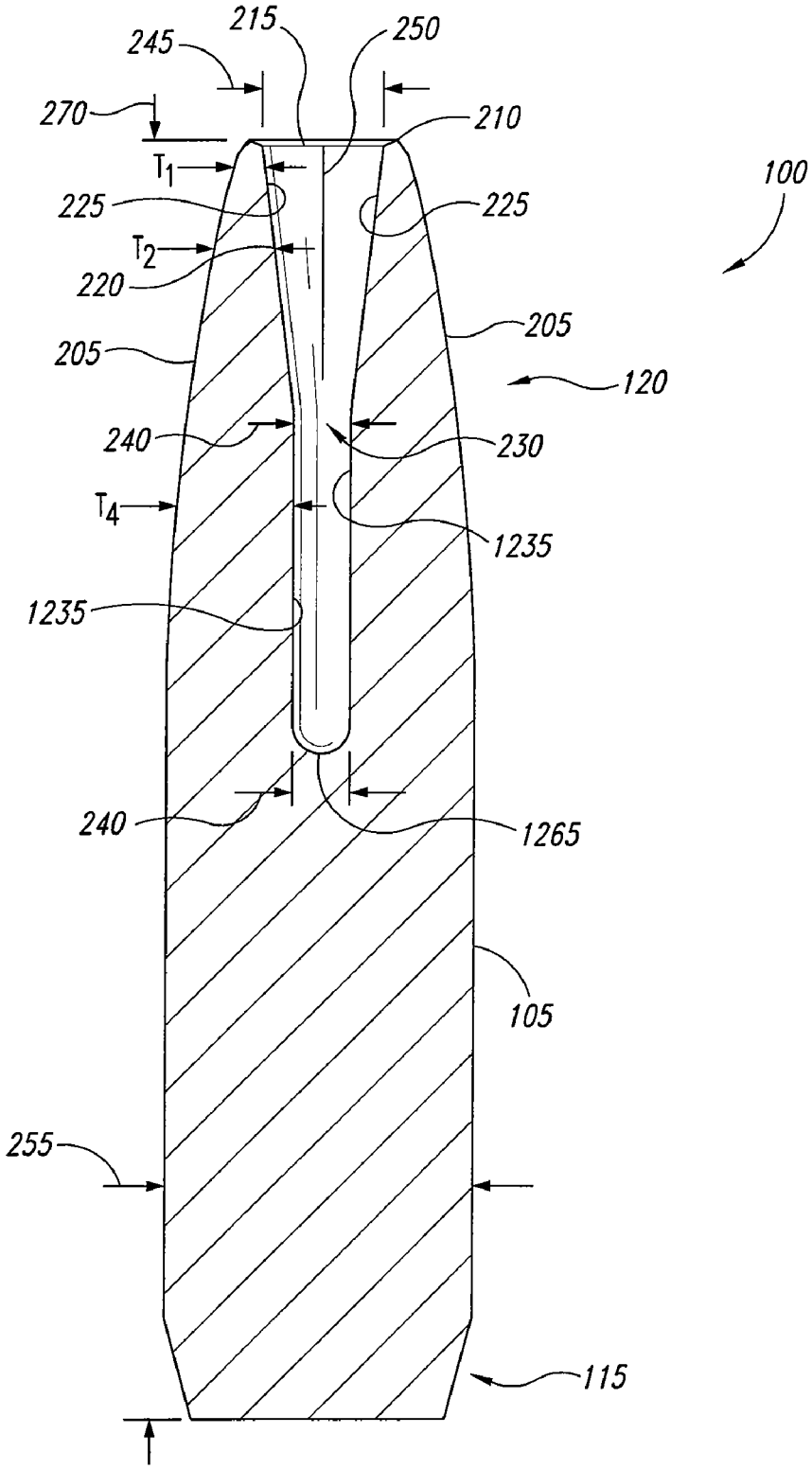
FIG. 12 is a cross-sectional view of a bullet in accordance with another embodiment.

FIG. 12 is a cross-sectional view of a bullet in accordance with another embodiment, and like reference numbers refer to like components in FIGS. 1-2B and 12. In FIG. 12, at least a portion of the rear sidewall 1235 has a cylindrical surface rearward from the transition area 230. The cylindrical surface, for example, can extend from the transition zone to the beginning of the generally hemispherical cavity end 1265. The cross-sectional dimension 240 at the transition area 230 is the same as the cross-sectional dimension 240 at the generally hemispherical cavity end 1265.

From the foregoing, it will be appreciated that specific embodiments of the invention have been described herein for purposes of illustration, but that various modifications may be made without deviating from the spirit and scope of the invention. For example, the elements of one embodiment can be combined with other embodiments in addition to or in lieu of the elements of other embodiments. Accordingly, the invention is not limited except as by the appended claims.

I claim:

1. A bullet comprising a lead-free body having a tail section, a nose section having an ogived outer surface and a forward terminus, an opening at the forward terminus, the opening having a first-cross sectional dimension, and a cavity in the nose section extending rearward from the opening to an intermediate section of the body, wherein the cavity includes a forward sidewall that has at least a generally frusto-conical shape extending from the opening to a second cross-sectional dimension, the forward sidewall converging rearward from the first cross-sectional dimension to the second cross-sectional dimension, and a rear sidewall contiguous with the forward sidewall and extending directly from the second cross-sectional dimension to a third cross-sectional dimension, the rear sidewall diverging rearward from the second cross-sectional dimension to the third cross-sectional dimension.

2. The bullet of claim 1 wherein the body includes longitudinal skives in the forward sidewall.

3. The bullet of claim 1 wherein at least a portion of the rear sidewall converges to form a generally hemispherical end of the cavity.

4. The bullet of claim 1 wherein the lead-free body includes copper.

5. The bullet of claim 1 wherein the lead-free body includes a copper-zinc alloy.

6. The bullet of claim 1 wherein the lead-free body includes copper 210 alloy.

7. The bullet of claim 1 wherein the opening at the terminus is generally circular.

8. The bullet of claim 1, further comprising a separate polymeric tip in the opening projecting forward from the terminus.

9. The bullet of claim 1 wherein at least a portion of the cavity has an hourglass-shape.

10. The bullet of claim 1 wherein the body further comprises a cavity end having a fourth cross-sectional dimension, and wherein the body has a first wall thickness at the second cross-sectional dimension and a second wall thickness at the fourth cross-sectional dimension, the second wall thickness greater than the first wall thickness.

11. A bullet comprising a lead-free body having a tail section, a nose section having an ogived outer surface and a forward terminus, an opening at the forward terminus, and a cavity in the nose section including a forward sidewall extending rearward convergently from the opening toward a transition area, the body having a first wall thickness at the transition area, skives in the forward sidewall, a rear sidewall contiguous with the forward sidewall and diverging rearward from the transition area, and a cavity end, the body having a second wall thickness at the cavity end, the second wall thickness greater than the first wall thickness, wherein the forward sidewall and the rear sidewall are configured to form petals upon impact in animal tissue that remain with the body at impact velocities of approximately 1,800 ft/sec to approximately 3,200 ft/sec.

12. The bullet of claim 11 wherein the transition area is a first transition area, the rear sidewall extends rearward divergently from the first transition area to a second transition area, and at least a portion of the rear sidewall extends rearward convergently to form a generally hemispherical end of the cavity.

13. The bullet of claim 11 wherein the lead-free body includes copper.

14. The bullet of claim 11 wherein the lead-free body includes a copper-zinc alloy.

15. The bullet of claim 11 wherein the lead-free body includes copper 210 alloy.

16. The bullet of claim 11, further comprising a tip in the opening projecting forward from the terminus.

17. The bullet of claim 11 wherein at least a portion of the cavity has an hourglass-shape.

18. The bullet of claim 11 wherein the transition area is a first transition area, and wherein the rear sidewall diverges rearward from the first transition area to a second transition area and converges rearward from the second transition area to the cavity end.

19. A bullet comprising a lead-free body having a tail section, a nose section having an ogived outer surface and a forward terminus, an opening at the forward terminus, the opening having a first-cross sectional dimension, and a cavity in the nose section extending rearward from the opening to an intermediate section of the body, wherein:

the cavity includes a forward sidewall having at least a generally frusto-conical shape extending from the opening to a second cross-sectional dimension, the forward sidewall converging rearward from the first cross-sectional dimension to the second cross-sectional dimension, and a rear sidewall extending directly from the second cross-sectional dimension to a third cross-sectional dimension, the rear sidewall diverging rearward from the second cross-sectional dimension to the third cross-sectional dimension;

the body has a maximum cross-sectional dimension, and the ratio of the first cross-sectional dimension to the maximum cross-sectional dimension is approximately 0.30 to approximately 0.40;

the body has a length and the ratio of the distance of the second cross-sectional dimension rearward of the forward terminus to the body length is approximately 0.20 to approximately 0.25; and the ratio of the second cross-sectional dimension to the maximum cross-sectional dimension is approximately 0.15 to approximately 0.25.

20. The bullet of claim 19 wherein:

the rear sidewall converges from the second transition area to form a generally hemispherical end of the cavity; and the ratio of the distance of the third cross-sectional dimension rearward of the forward terminus to the body length is approximately 0.30 to approximately 0.35, and the ratio of the distance of the generally hemispherical end location rearward of the forward terminus to the body length is approximately 0.45 to approximately 0.50.

21. The bullet of claim 20 wherein:

the ratio of the third cross-sectional dimension to the maximum cross-sectional dimension is approximately 0.20 to approximately 0.30; and the generally hemispherical end of the cavity has a fourth cross-sectional dimension and the ratio of the fourth cross-sectional dimension to the maximum cross-sectional dimension is approximately 0.10 to approximately 0.20.

22. The bullet of claim 19 wherein the body includes copper.

23. The bullet of claim 19 wherein the body includes a copper-zinc alloy.

24. The bullet of claim 19 wherein the body includes copper 210 alloy.

25. The bullet of claim 19 further comprising a tip in the opening that extends forwardly from the terminus.

* * * * *